US005305490A

United States Patent [19]

Lundgren

[11] Patent Number: 5,305,490

[45] Date of Patent: Apr. 26, 1994

[54] TOOTHBRUSH WITH FIRM GRIP HANDLE

[76] Inventor: James F. Lundgren, 723 71st Ave. No., St. Petersburg, Fla. 33702

[21] Appl. No.: 47,298

[22] Filed: Apr. 19, 1993

[51] Int. Cl.[5] ..... A46B 9/04

[52] U.S. Cl. ..... 15/167.1; 15/143.1; D4/104

[58] Field of Search ..... 15/143.1, 167.1, 167.2, 15/184, 248.1; 132/308, 311; 16/110 R, 111 R; 81/489, 490; D4/104, 138

[56] References Cited

U.S. PATENT DOCUMENTS

| | | | |
|---|---|---|---|
| D. 37,997 | 5/1906 | Tower | 81/489 |
| 1,340,043 | 5/1920 | Grace | 132/311 |
| 1,773,041 | 8/1930 | Healy | 132/311 |
| 1,893,002 | 1/1933 | Rothschild | 15/167.1 |
| 2,244,615 | 6/1941 | Garcin | 15/167.2 |
| 2,263,885 | 11/1941 | McGauley | 15/167.1 |
| 2,701,379 | 2/1955 | Balistreri | 15/143.1 |
| 2,845,646 | 8/1958 | Robinson | 15/184 |
| 4,209,871 | 7/1980 | Ernest et al. | 15/167.1 |
| 4,558,483 | 12/1985 | Noser | 15/248.1 |

FOREIGN PATENT DOCUMENTS

| | | | |
|---|---|---|---|
| 15575 | 11/1934 | Australia | 15/184 |
| 451964 | 5/1913 | France | 15/184 |
| 82/00576 | 3/1982 | PCT Int'l Appl. | 132/311 |
| 333001 | 5/1959 | Switzerland | 15/167.1 |
| 379150 | 8/1932 | United Kingdom | 15/167.1 |
| 396846 | 8/1933 | United Kingdom | 15/143.1 |

*Primary Examiner*—Stephen F. Gerrity
*Assistant Examiner*—Mark Spisich

[57] ABSTRACT

The disclosure relates to a light weight monolithically fabricated toothbrush affording a person with inadequate hand strength greatly improved gripping and control characteristics by utilizing an enlarged lightweight tubular handle with an anti slip gripping surface specifically designed to deter retention of bacteria forming moisture and excess toothpaste.

1 Claim, 1 Drawing Sheet

TOOTHBRUSH WITH FIRM GRIP HANDLE

BACKGROUND OF THE INVENTION

1. Field of the Invention

This invention relates to a tooth brush with greatly improved gripping and control characteristics having an enlarged handle with an anti slip gripping surface that affords a person with inadequate hand strength a firm comfortable and controlling grip on the tooth brush handle.

2. Description of the Prior Art

Prior art is repleat with various renditions of toothbrush designs. The vast majority are mainly concerned with the technical aspects of improving the brushing efficiency of the toothbrush as a whole. There are some with larger handles that are intended to house an electric motor or store some other tooth brushing aid. Some handles are made large enough to store the head of a traveling toothbrush. None of the above designs make any conscious effort to improve the user's grip. Beebe, U.S. Pat. No. 4,283,808, teaches an after market gripping device for tooth brushes adapted to be positioned over the handle of the toothbrush wherein the device is formed of soft plastic foam material. The problem with the plastic foam gripping device is that plastic foam tends to absorb moisture, therefore, by it's very nature, is unsanitary. Furthermore, the consistency of plastic foam enables the toothbrush handle to move independently from the exterior surface of the slip on gripping device. The independent movement of the toothbrush, caused by the inherent mechanical instability of foam plastic, creates a condition wherein the all important rotational and longitudinal control of the toothbrush handle is virtually non existent.

Previous attempts at improved grip toothbrushes have resulted in solid handle expensive devices that are not compatible with both the left and right handed user.

There is no prior art that teaches the use of a one piece reasonably priced toothbrush having an oversized tubular handle designed specifically to afford a normal left or right handed person with inadequate hand strength a firm comfortable grip on the toothbrush handle. Furthermore, there is no prior art that teaches the prevention of surplus toothpaste and moisture from flowing, while in the act of scrubbing one's teeth, on to the gripping area of a toothbrush.

SUMMARY OF THE INVENTION

The object of this invention is to provide a affordably priced practical one piece toothbrush having an oversized tubular handle specifically designed to afford a left or right handed person with inadequate hand strength means to comfortably and controllably grip the toothbrush handle.

A further object of this invention is to provide an anti slip sanitary appliance handle fabricated of impermeable material to prevent moisture absorption and designed in such a manner to discourage the retention of moisture and excess toothpaste and the resultant potentially harmful bacteria.

A still further object of this invention is to provide a handle having means to prevent surplus toothpaste and moisture from flowing, while in the act of scrubbing one's teeth, on the gripping area of the toothbrush.

Another object of this invention is to provide a handle that will be compatible with left or right hand users.

Further advantages of this invention will be outlined in the accompanying drawings and specifications.

DETAILED DESCRIPTION OF THE INVENTION

Figure 1:
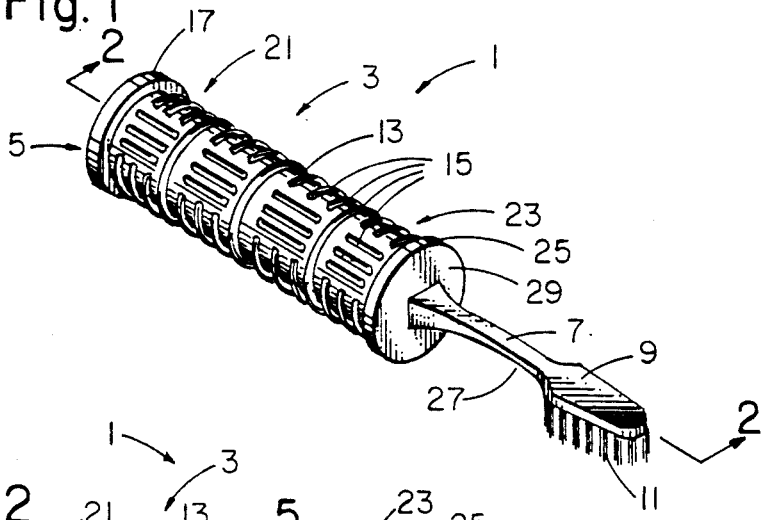
FIG. 1 is a perspective view of the invention, fabricated in one piece and showing the handle, with a rendition of the grip improving ridges and their relative position with regard to the brush head attitude, the brush head and the shaft that connects the head to the handle.

The invention, as show in it's entirety in FIG. 1, is best described as a toothbrush 1, fabricated, with the exception of the open end 21 enclosing plug 5, in one piece, of non porous material and comprised of a tubular handle 3 having an anti slip gripping surface 13 with an enclosing plug 5 at one end 21 and an integral enclosure 23 at the opposite end. Extending from the exterior face of enclosure 23 and generally in line with the longitudinal axis of the handle 3 is a shaft 7 extending to an integrality terminating at a head 9 having bristles 11 affixed thereto.

Figure 2:
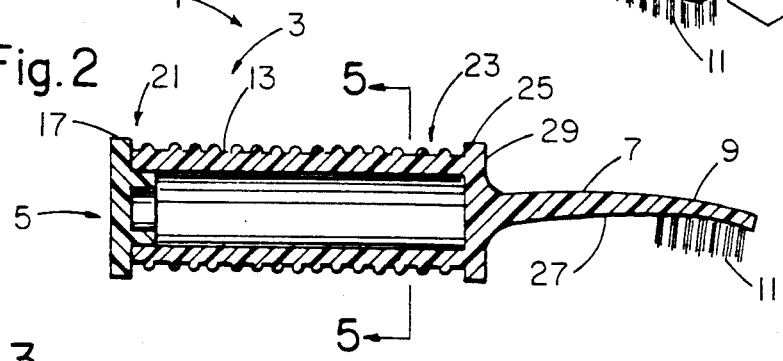
FIG. 2 is a cross section of the side view of the invention showing the tubular handle with end plug and integral closed end structure, the included shaft and the head, complete with bristles.
Figure 3:
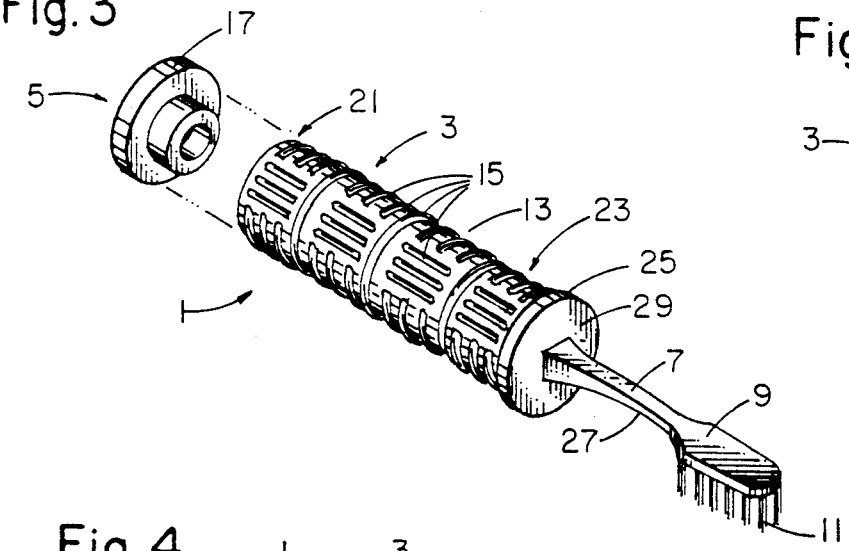
FIG. 3 is a an exploded perspective view of the invention showing the end plug and it's relationship to the open end of the handle.

The handle 3 of the invention as shown in FIGS. 1 and 2 is of such a dimension and configuration as to provide a user, having inadequate hand strength, with a comfortable controlling grip. The handle 3 of the invention is fabricated of impermeable sanitary material and in a tubular configuration in order to minimize unnecessary weight. The gripping surface 13 of the handle 3 is of anti slip configuration comprised of intermittent raised ridges 15, as opposed to a rough anti slip surface prone to retaining unsanitary particles, wherein the intermittent raised ridges 15 are of such a configuration as to discourage retention of moisture and excess toothpaste. The typical intermittent raised ridges 15 are placed both in line with and at right angles to the longitudinal axis of the handle 3 tend to prevent both longitudinal and radial hand slippage.

Figure 5:
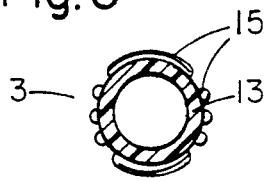
FIG. 5 is a cross section view of the open end of the handle.
Figure 4:
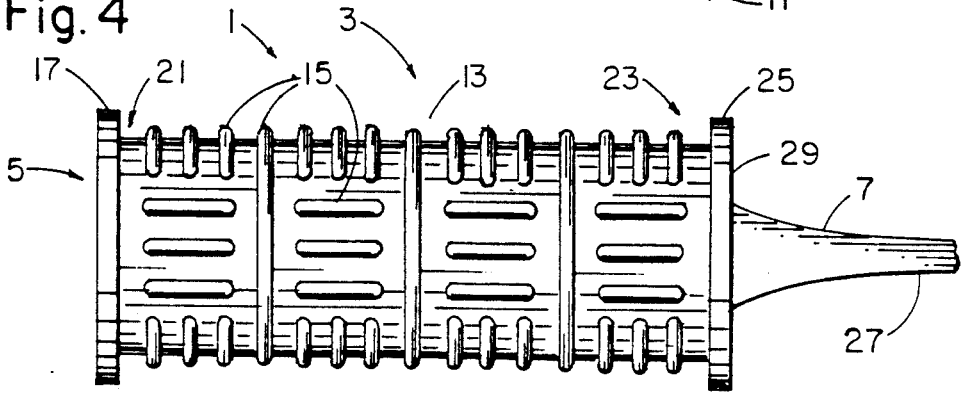
FIG. 4 is an enlarged top view of the handle of the invention showing a rendition of the anti slip ridges as applied in one possible arrangement.

The open end 21 of the handle 3 is enclosed by a plug 5 having a first curb having a perimeter of greater dimension greater than the cross section peripheral dimension FIG. 5 of the open end gripping surface 13 of the handle 3. Further means to prevent longitudinal slippage of the user's hand beyond the plug 5 end of the handle 3 is provided by the curb 17 thus formed.

The other end 23 of the handle 3 is fabricated in a closed configuration. The integrally enclosed opposite end 23 of the handle 3 has a second curb 25 similar the first curb 17 in that it also has a perimeter dimension greater than the perimeter dimension of the handle gripping area to further prevent longitudinal slippage of the user's hand beyond the closed end 23 of handle 3. Another function of the curb 25 at the closed end 23 of the handle 3 is to prevent excess moisture and toothpaste from flowing back on to the user's hand.

Originating from the integral closed end 23 external surface plane 29 that is at right angles to the longitudinal axis of the handle 3 and generally in line with longitudinal axis of the handle 3 is the integrally fabricated shaft 7 that connects to the head 9 of the brush 1 in an integral manner. Thus, the handle 3, end closure 23, the shaft 7 and the head 9 are a monolithic structure. The shaft 7 is shown as being fabricated with a curvature that generally approximates the curvature line of teeth in a human jaw bone. The prefered configuration of shaft 7 is further fabricated in such a manner as to allow the head 9 to controllably flex in the plane of the arc 27 to the most advantageous brushing position.

The head 9, being of generally rectangular configuration and of such thickness as may be required to affix bristles thereto, is integrally affixed to the opposite end of the shaft 7 and having the widest plane of the head 9 at right angles to the plane of arc 27 with the bristles of the head pointing in the general direction of the originating point of the plane of arc 27.

What is claimed is:

1. A toothbrush comprising:

(a) an elongated tubular handle having a first closed end and a second open end, said handle being hollow between said first and second ends, said handle having an exterior gripping surface;

(b) said gripping surface having means thereon for enhancing gripping thereof by a user;

(c) a plug which engages and encloses the open end of the handle, a portion of which fits within the hollow handle;

(d) a first curb extending outwardly from said plug and defining a peripheral edge which extends radially outward a greater distance than the exterior gripping surface of the handle;

(e) a second curb at said closed end of said handle extending outwardly therefrom and defining a peripheral edge which extends radially outward a greater distance than the exterior gripping surface of the handle, said gripping surface being defined between said first and second curbs;

(f) an elongated shaft having one end thereof extending from said closed end of said handle and having at a second opposite end a generally rectangular brush head having bristles projecting outwardly therefrom, said elongated shaft being generally aligned with the longitudinal axis of the handle; and (g) said handle and shaft being integrally fabricated to define a monolithic structure.

* * * * *